US007044778B2

(12) United States Patent
Tanaka

(10) Patent No.: US 7,044,778 B2
(45) Date of Patent: May 16, 2006

(54) CONNECTOR HAVING A SHELL WHICH CAN READILY BE FIXED TO A CONNECTOR HOUSING

(75) Inventor: Yukitaka Tanaka, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 5 days.

(21) Appl. No.: 10/848,135

(22) Filed: May 19, 2004

(65) Prior Publication Data

US 2004/0235349 A1 Nov. 25, 2004

(30) Foreign Application Priority Data

May 22, 2003 (JP) ..... 2003-145379

(51) Int. Cl.
*H01R 13/60* (2006.01)

(52) U.S. Cl. ..... 439/541.5

(58) Field of Classification Search ..... 439/607–608, 439/490, 610, 488, 609, 79, 571
See application file for complete search history.

(56) References Cited

U.S. PATENT DOCUMENTS

| | | | | |
|---|---|---|---|---|
| 5,580,283 | A | 12/1996 | O'Sullivan et al. | |
| 5,800,207 | A * | 9/1998 | Hsu et al. | 439/541.5 |
| D420,979 | S | 2/2000 | Chang | |
| 6,193,555 | B1 | 2/2001 | Chang | |
| 6,206,730 | B1 * | 3/2001 | Avery et al. | 439/609 |
| 6,299,482 | B1 | 10/2001 | Huang | |
| D453,738 | S | 2/2002 | Shao et al. | |
| D454,336 | S | 3/2002 | Manchester et al. | |
| 6,386,910 | B1 * | 5/2002 | Yu | 439/567 |
| D468,693 | S | 1/2003 | Kuo | |
| 6,547,595 | B1 | 4/2003 | Tanaka | |
| 6,561,847 | B1 | 5/2003 | Xiang et al. | |
| D478,552 | S | 8/2003 | Zhang et al. | |
| 6,629,859 | B1 | 10/2003 | Hoshino et al. | |
| 6,688,909 | B1 * | 2/2004 | Espenshade et al. | 439/490 |
| 6,699,065 | B1 * | 3/2004 | Espenshade et al. | 439/490 |
| D488,132 | S | 4/2004 | Tanaka | |
| D505,116 | S | 5/2005 | Tanaka | |
| 6,893,269 | B1 | 5/2005 | Matsunaga | |

FOREIGN PATENT DOCUMENTS

| | | |
|---|---|---|
| JP | 7192813 | 7/1995 |
| JP | 2002231391 | 8/2002 |
| JP | 3495007 | 11/2003 |
| KR | 332379 | 8/2003 |

* cited by examiner

*Primary Examiner*—J. F. Duverne
(74) *Attorney, Agent, or Firm*—Baker Botts L.L.P.

(57) ABSTRACT

In a connector to be mounted on a circuit board having a ground pattern, a connecting member is assembled to a housing holding a contact. The connecting member has conductivity for electrically connecting with the ground pattern. A shell is coupled to the housing and is for electromagnetically shielding the contact. The shell includes first and second shells. The first shell has conductivity and assembled to the housing in a fitting direction of the connector to surround a contact portion of the contact. The second shell has conductivity and assembled to the housing in a particular direction orthogonal to the fitting direction. The second shell covers a terminal portion of the contact and clamps the housing and the connecting member in the fitting direction. The first shell is in contact with the second shell and is fixed to the connecting member.

9 Claims, 4 Drawing Sheets

CONNECTOR HAVING A SHELL WHICH CAN READILY BE FIXED TO A CONNECTOR HOUSING

This application claims priority to prior Japanese patent application JP 2003-145379, the disclosure of which is incorporated herein by reference.

BACKGROUND OF THE INVENTION

This invention relates to a connector and, in particular, to a connector having an electromagnetic shielding function.

In recent years, an electronic apparatus such as a computer, a server, and an exchange is remarkably wide spread. Since the electronic apparatus of the type transmits a high-speed electronic signal, a connector used as an I/O port of the apparatus is desired to have an electromagnetic interference protection.

Unlike ordinary electronic components, the connector can not entirely be covered with a shielding case for protection against electromagnetic interference. If the connector is entirely covered with the shielding case, the connector can not achieve electrical and mechanical connection with a mating object to be connected. Under the circumstances, it is desired for the connector to be enhanced in electromagnetic shielding function without being entirely covered with the shielding case.

For example, Japanese Patent Application Publication (JP-A) No. H7-192813 discloses a connector comprising a connector body covered with a metal shell. Japanese Patent Application Publication (JP-A) No. 2002-231391 (corresponding to U.S. Pat. No. 6,629,859) discloses a connector in which a housing and a contact held by the housing are covered with a front shell and a back shell each of which is made of metal.

In these connectors, the shell can be connected to the housing by the use of a caulking or staking technique. However, the caulking technique requires a caulking tool and a caulking operation. As a consequence, it is troublesome to assemble and disassemble the connector. In addition, a production cost is inevitably increased.

SUMMARY OF THE INVENTION

It is therefore an object of the present invention to provide a connector in which a shell can be fixed to a housing without using a caulking technique.

Other objects of the present invention will become clear as the description proceeds.

According to aspect of the present invention, there is provided a connector to be mounted on a circuit board having a ground pattern, the connector comprising a contact made of a conductive member and having a contacting portion and a terminal portion, a housing holding the contact and defining a fitting direction of the connector, a shell coupled to the housing for electro-magnetically shielding the contact, and a connecting member assembled to the housing and having conductivity for electrically connecting with the ground pattern. The shell comprises a first shell having conductivity and assembled to the housing in the fitting direction to surround the contacting portion of the contact and a second shell having conductivity and assembled to the housing in a particular direction orthogonal to the fitting direction, the second shell covering the terminal portion of the contact and clamping the housing and the connecting member in the fitting direction, the first shell being in contact with the second shell and being fixed to the connecting member.

DESCRIPTION OF PREFERRED EMBODIMENTS

Figure 1B:
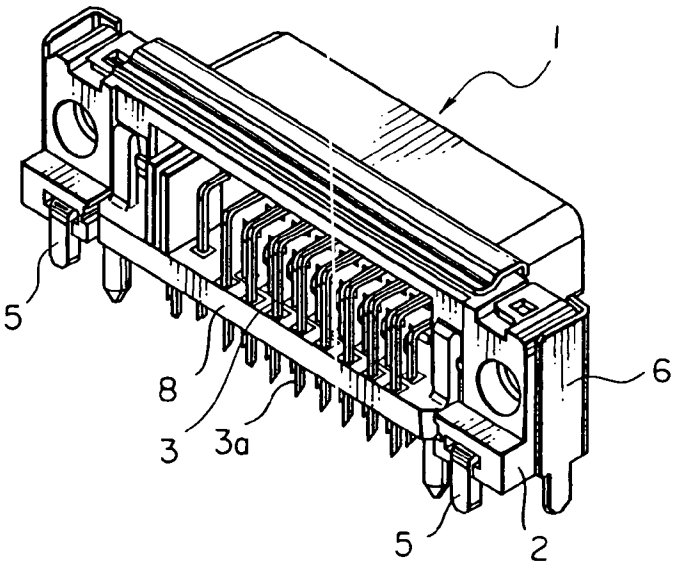
FIG. 1B is a perspective view of the connector in FIG. 1A as seen from a rear side, with some components omitted for illustrating an internal mechanism.
Figure 1A:
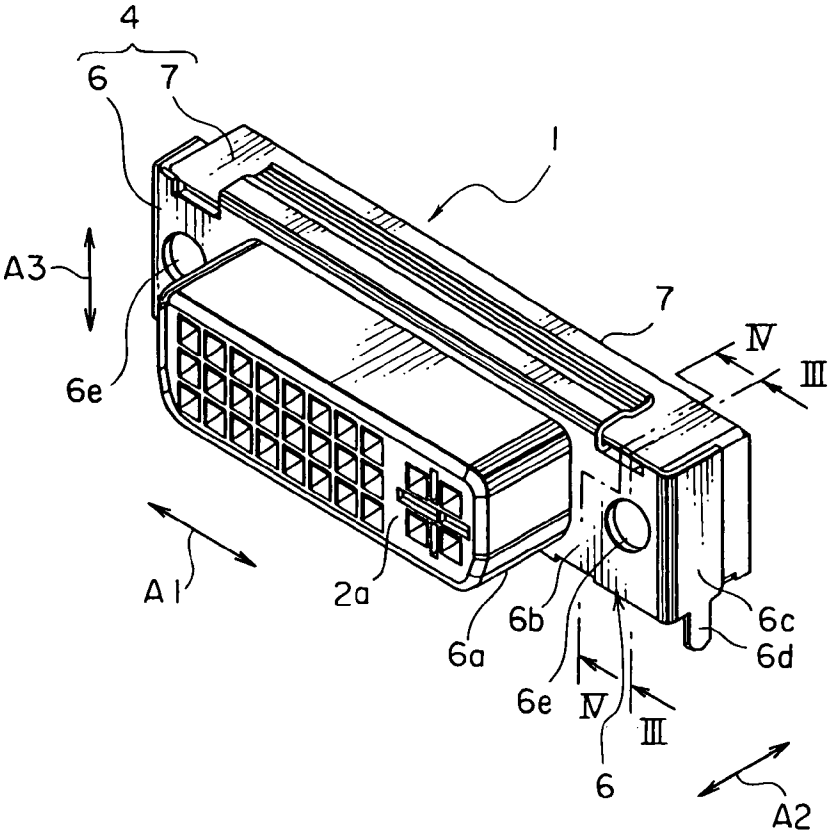
FIG. 1A is a perspective view of a connector according to one embodiment of the present invention as seen from a front side.
Figure 2:
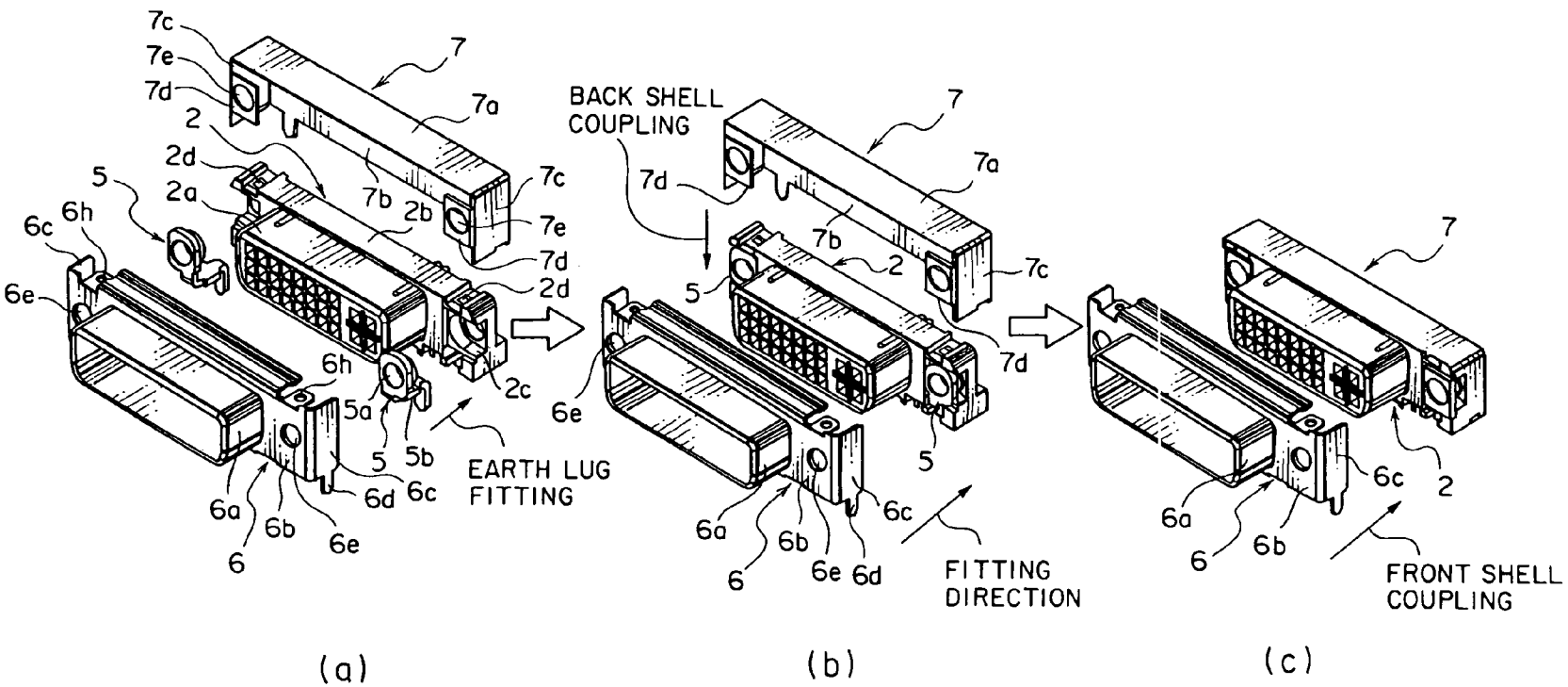
FIG. 2 shows an assembling process of the connector illustrated in FIGS. 1A and 1B.

Referring to FIGS. 1A, 1B, and 2, description will at first be made of an entire structure of a connector according to one embodiment of the present invention.

The connector depicted at 1 in the figure comprises an insulating housing 2, a plurality of conductive contacts 3 held by the housing 2 and arranged in a first direction A1 which is referred to as a particular direction, a shell 4 for electro-magnetically shielding the contacts 3, and a pair of conductive earth lugs 5 as a connecting member to be connected to a conductive ground pattern of a board or substrate (not shown) such as a circuit board. The contacts 3 are extends parallel to one another in second and third directions A2 and A3 which are orthogonal to the first direction A1 and orthogonal to each other. The second direction A2 is referred to as a fitting direction.

Each of the contacts 3 is made of a conductive member such as a metal plate and has a contacting portion (not shown) formed at one end and a terminal portion 3*a* formed at the other end. The contacting portions of the contacts 3 are positioned inside a protruding portion 2*a* at a front side of the housing 2 and arranged in eight columns and three rows. The terminal portion 3*a* of each contact 3 protrudes from a rear surface of a main body 2*b* of the housing 2 and is bent into a generally L-shaped configuration. The terminal portions 3*a* of the contacts 3 are held by a location plate 8 to be positioned and aligned. The earth lugs 5 are made of metal material and are fixed to the housing 2 by the use of a pair of receiving portions 2*c* formed at left and right sides of the housing 2.

The shell 4 comprises a conductive first shell, i.e., a front shell 6 covering the contacting portions of the contacts 3 and a conductive second shell, i.e., a back shell 7 covering the terminal portion of the contacts 3. Each of the front shell 6 and the back shell 7 is made of a metal plate. A fixing structure of the front shell 6 and the back shell 7 to the housing 2 will later be described.

The front shell 6 has a cylindrical portion 6*a* fitted to an outer peripheral surface of the protruding portion 2*a* of the housing 2, a front plate portion 6*b* covering a front surface of the main body 2*b* of the housing 2, a pair of side plate portions 6*c* covering opposite side surfaces of the main body 2*b*, and a pair of terminal portions 6*d* protruding downward from the side plate portions 6*c*, respectively. The front shell 6 is coupled with the housing 2 in the second direction A2 and fixed to the housing 2.

The back shell 7 has an upper plate portion 7*a* covering an upper surface of the main body 2*b* of the housing 2, a rear plate portion 7*b* faced to the rear surface of the main body 2*b* with a space left therefrom, a pair of side plate portions 7*c* covering the opposite side surfaces of the main body 2*b*, and a pair of terminal portions 7*f* formed at left and right sides of a lower edge of the rear plate portion 7*b*. Each of the side plate portions 7*c* is for connecting to the ground pattern of the substrate. Before the front shell 6 is coupled with the housing 2, the back shell 7 is coupled with the housing 2 in the third direction A3.

Particularly referring to FIG. 2, description will be made of assembling of the front shell 6 and the back shell 7 into the housing 2.

At first, as illustrated in (a), the earth lugs 5 are fitted into the receiving portions 2*c* of the housing 2 in directions depicted by rearward arrows. Each of the earth lugs 5 is provided with a female thread 5*a* formed at its upper part and a generally L-shaped terminal portion 5*b* formed at its lower part. Each of the terminal portions 5*b* is connected to the ground pattern of the substrate.

Next, as illustrated in (b), the back shell 7 is coupled with the housing 2 in a direction depicted by a downward arrow. The back shell 7 has a pair of square plates 7*d* formed at front edges of the side plate portions 7*c* and extending in the first and the third directions A1 and A3. Each of the square plates 7*b* has a circular hole 7*e*.

Subsequently, as illustrated in (c), the front shell 6 is coupled with the housing 2 and the back shell 7 in a direction depicted by a rearward arrow. The front plate portion 6*b* of the front shell 6 has a pair of circular holes 6*e* formed at left and right sides thereof.

The connector 1 is fixed to a panel (not shown) in the following manner. At first, the cylindrical portion 6*a* is protruded through an opening formed in the panel. Next, a pair of screws (not shown) are inserted from a front side of the panel through corresponding holes formed in the panel and the circular holes 6*e* to be screwed into the female threads 5*a*. Thus, the panel, the housing 2, the front shell 6, the back shell 7, and the earth lugs 5 are integrally fixed.

Figure 3:
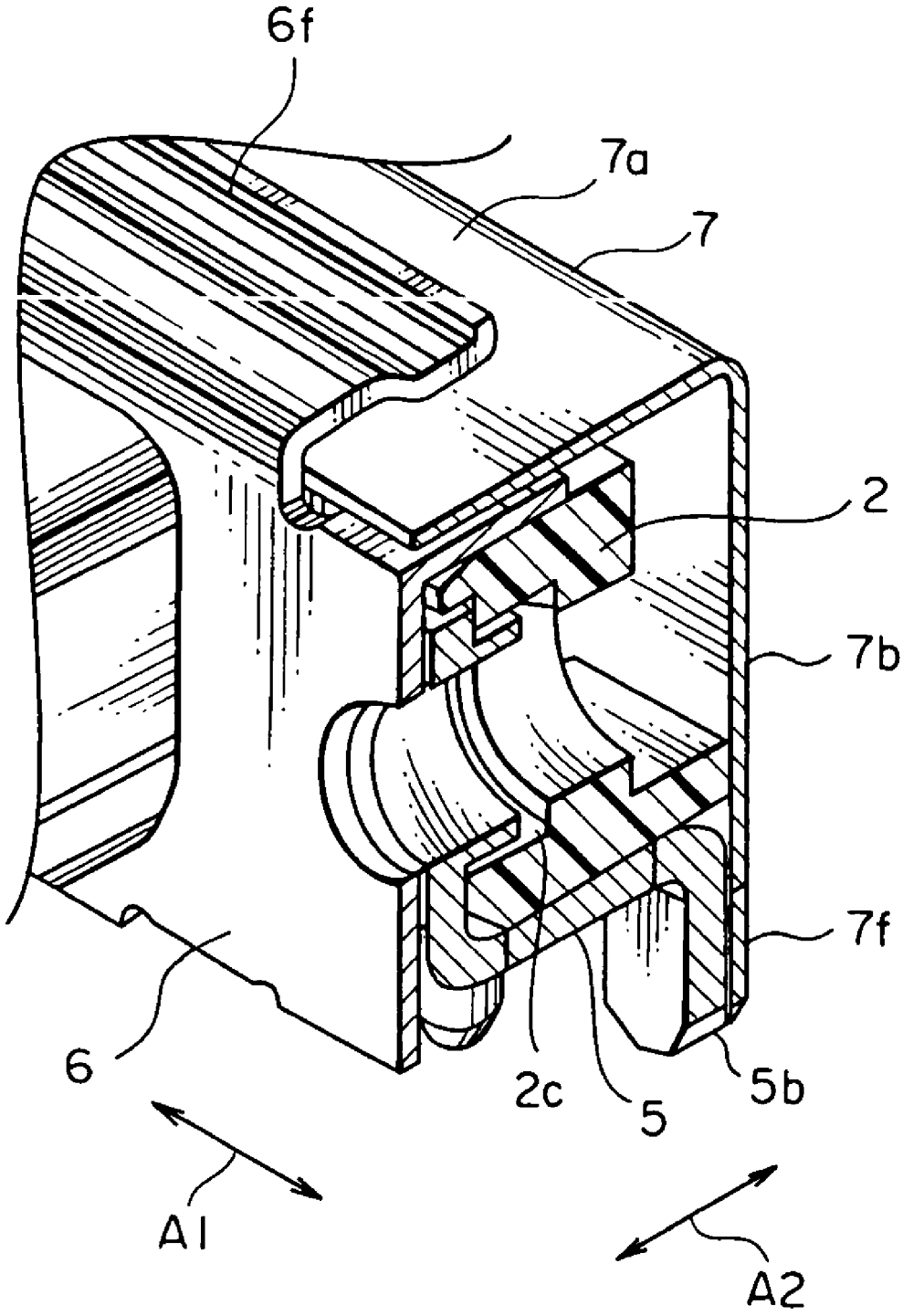
FIG. 3 is an exploded perspective view of a characteristic part of the connector, having a section taken along a line III—III in FIG. 1A.
Figure 4A:
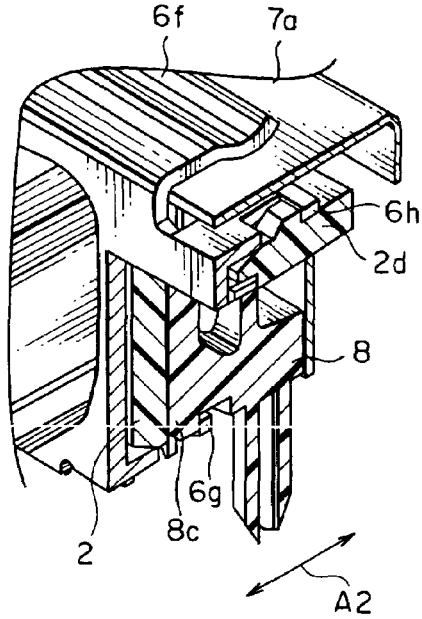
FIG. 4A is an exploded perspective view similar to FIG. 3, having a section taken along a line IV—IV in FIG. 1A.
Figure 4B:
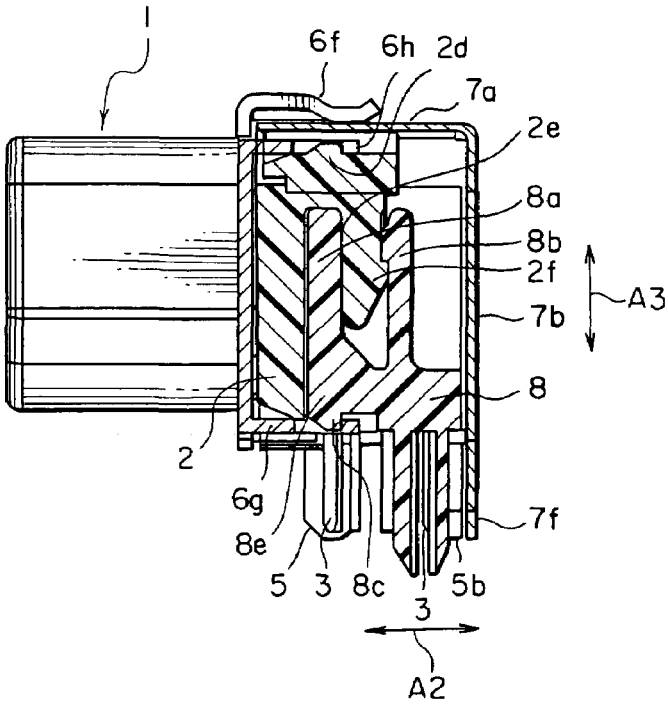
FIG. 4B is a right side view of the characteristic part illustrated in FIG. 4A.

Referring to FIGS. 3, 4A, and 4B, description will be made of a linking structure of the housing 2, the front shell 6, the back shell 7, the earth lugs 5, and the location plate 8.

The front shell 6 further has a contacting portion 6*f* formed at a center of an upper edge of the front plate portion 6*b* and bent rearward, and a pair of engaging portions 6*g* formed at left and right sides of a lower edge of the front plate portion 6*b* and bent rearward. The contacting portion 6*f* is elastically contacted with an upper surface of the upper plate 7*a* of the back shell 7. The engaging portions 6*g* are engaged with the location plate 8. Each of the terminal portions 6*d* is connected to the ground pattern of the substrate.

As described above, the terminal portions 7*f* are formed at the left and the right sides of the lower edge of the rear plate portion 7*b* of the back shell 7. Each of the terminal portions 7*f* is connected to the ground pattern of the substrate. The terminal portions 5*b* of the earth lugs 5 are placed adjacent to the terminal portions 7*f* of the back shell 7 in the second direction A2, respectively. Therefore, adjacent ones of the terminal portions 5*b* and 7*f* can be connected commonly to a connecting portion, such as a through hole, a pad, or the like, which is connected to the ground pattern of the substrate. With this structure, the substrate is made compact and the connector 1 is simplified in structure.

The front shell 6 has a pair of engaging portions 6*h* engaged with a pair of engaging portions 2*d* formed on an upper side of the main body 2*b* of the housing 2. The contacting portion 6*f* is contacted with the upper plate portion 7*a* of the back shell 7. The engaging portions 6*g* are engaged with a pair of protruding portions 8*c* formed at left and right sides of a lower surface of the location plate 8.

At each of both end portions in the first direction A1, the housing 2 has a groove 2*e* receiving a protruding portion 8*a* of the location plate 8 therein. The housing 2 has a hook 2*f* engaged with a hook 8*b* of the location plate 8.

In the structure of this embodiment, the back shell is clamped by the front shell on an upper side of the connector. On left and right sides of the connector, the back shell is clamped between the earth lugs and the front shell. Thus, the front shell and the back shell are contacted with each other on three sides, i.e., the upper, the left, and the right sides of the connector.

The front shell is fixed by the screws to the panel having a grand voltage in the manner known in the art. Thus, a ground electric current uniformly covers the connector. It is therefore possible to achieve an excellent shielding effect and to prevent internal noise generated inside the connector from leaking outside.

Signal reflection as one of noise generating factors can be prevented by a loop structure (the panel→ the connector→ the substrate→ the panel) obtained by providing the front shell and the back shell with the terminal portions mounted to the substrate and connected to the ground pattern of the substrate. Therefore, it if possible to provide an image interface connector having a shielding function and suitable for EMI protection.

Since the back shell and the earth lugs can be connected through the same through holes formed in the substrate, the back shell and the earth lugs form a loop structure. Thus, a shielding structure capable of preventing signal reflection and facilitating flow of a ground signal.

While this invention has thus far been described in conjunction with the preferred embodiment thereof, it will be readily possible for those skilled in the art to put this invention into practice in various other manners without departing from the scope set forth in the appended claims.

What is claimed is:

1. A connector to be mounted on a circuit board having a ground pattern, said connector comprising a contact made of a conductive member and having a contacting portion and a terminal portion, a housing holding said contact and defining a fitting direction of said connector, a shell coupled to said housing for electro-magnetically shielding said contact, and a connecting member assembled to said housing and having conductivity for electrically connecting with said ground pattern, said shell comprising:

a first shell having conductivity and assembled to said housing in said fitting direction to surround said contacting portion of the contact; and a second shell having conductivity and assembled to said housing in a particular direction orthogonal to said fitting direction, said second shell covering said terminal portion of the contact and clamping said housing and said connecting member in said fitting direction, said first shell being in contact with said second shell and being fixed to said connecting member, wherein said second shell has a plate portion clamped between said connecting member and said first shell in said fitting direction.

2. The connector according to claim 1, wherein said plate portion, said connecting member, and said first shell have through holes, respectively, which are communicated with one another in said fitting direction, said through holes being adapted for connecting said plate portion, said connecting member, and said first shell to one another.

3. The connector according to claim 1, further comprising a location plate coupled to said housing for positioning said terminal portion of the contact.

4. The connector according to claim 3, wherein said location plate serves to hold said first shell.

5. The connector according to claim 3, wherein said location plate has a protruding portion, said first shell having an engaging portion engaged with said protruding portion in said coupling direction.

6. The connector according to claim 3, wherein said housing has a groove, said location plate having a protruding portion inserted in said groove to be engaged with the housing in said coupling direction.

7. The connector according to claim 3, wherein said housing has a hook, said location plate having a hook engaged with said hook of the housing in said particular direction.

8. The connector according to claim 1, wherein each of said first and said second shells has at least one terminal portion to be connected to said ground pattern of the circuit board.

9. The connector according to claim 8, wherein said connecting member has a terminal portion to be connected to said ground pattern of the circuit board, said terminal portion of the second shell being placed adjacent to said terminal portion of the connecting member in said fitting direction.

* * * * *